United States Patent [19]

Lagreze et al.

[11] Patent Number: 4,701,228

[45] Date of Patent: Oct. 20, 1987

[54] PROCESS FOR THE MANUFACTURE OF A DOUBLE-BASE PROPELLENT COMPOSITION WITH LOW FLAME-GLARE EMISSION

[75] Inventors: Richard Lagreze, La Couronne; Georges Malescot, Angouleme, both of France

[73] Assignee: Societe Nationale des Poudres et Explosifs, Paris, France

[21] Appl. No.: 916,308

[22] Filed: Oct. 7, 1986

[30] Foreign Application Priority Data

Oct. 14, 1985 [FR] France ..... 85 15170

[51] Int. Cl.[4] ..... D03D 23/00

[52] U.S. Cl. ..... 149/109.6; 149/95; 149/97; 149/98; 149/100; 264/3.1

[58] Field of Search ..... 149/95, 97, 98, 100, 149/109.6; 264/3.1

[56] References Cited

U.S. PATENT DOCUMENTS 3,867,214 2/1975 Zucker et al. ..... 149/100
3,867,215 2/1975 Zucker et al. ..... 149/100
3,960,621 1/1976 Whitworth et al. ..... 149/100
3,985,594 10/1976 Bjorn ..... 149/108.4
4,381,270 4/1983 Bjorn et al. ..... 149/14

*Primary Examiner*—Stephen J. Lechert, Jr.
*Attorney, Agent, or Firm*—Bucknam and Archer

[57] ABSTRACT

The invention relates to a process for the manufacture of a double-base propellent composition with low flame-glare emission, and a propellent composition thus obtained.

The process of the invention consists in casting a nitrocellulose-based moulding powder with a nitroglycerine-based casting solvent. According to the invention, the moulding powder consists of a mixture of two powders, one of which contains the antiglare agents, and the weight ratio of the powder containing the antiglare agents to the other powder is between 15/85 and 50/50. The invention permits an antiglare agent to be added to a propellent composition without affecting the ballistic properties of the composition, while strengthening the antiglare effect of this agent.

The invention is applicable particularly in the field of solid-fuel propulsion.

10 Claims, No Drawings

PROCESS FOR THE MANUFACTURE OF A DOUBLE-BASE PROPELLENT COMPOSITION WITH LOW FLAME-GLARE EMISSION

The present invention relates to a process for the manufacture of a propellent composition with a double-base propellant using the casting method, and a composition obtained using this process.

Its subject is more particularly a process for the manufacture of a double-base propellant with a low temperature coefficient and low flame-glare emission.

A double-base propellant comprises essentially two energetic constituents, namely a cellulose nitrate such as, for example, nitrocellulose, and a nitrated oil such as, for example, nitroglycerine.

These compositions may be manufactured by various processes, such as the solvent-free process with extrusion of the composition, or what is known as the casting process. This latter process consists in producing a moulding powder containing nitrocellulose to which ballistic additives, plasticizers and, if desired, a small proportion of nitrated oil are added, and then gelling this powder with a casting solvent consisting of nitrated oil and an inert solvent such as triacetin, the purpose of which is to phlegmatize the nitrated oil. For this stage, the moulding powder is arranged in a mould, then the casting solvent is fed into the latter until the powder is completely submerged. The cast propellant block is then subjected to a heat treatment in order to complete the gelling of the nitrocellulose.

To obtain high ballistic properties it is frequently necessary to add combustion catalysts which accelerate the rate of combustion of the propellant. These catalysts are generally lead or copper salts, and acetylene black.

In addition, it is also desirable to add ballistic modifiers which do not affect the rate of combustion but affect the operating conditions of the propellant and, in particular, the composition and the temperature of the combustion gases. Thus, these additives may be, in particular, glare-reducing agents which attenuate flame glares.

In fact, the combustion gases may contain compounds which are not completely oxidized and which, in contact with atmospheric oxygen, may ignite on leaving the nozzle of the propelling device. The phenomenon is generally referred to as postcombustion.

These flame glares are inconvenient because they detract from the unobtrusiveness of the propelled device and may greatly disturb the guidance of the device, especially when the guidance is provided by means of radar or infrared radiation.

In order to attenuate and even to eliminate these glares, salts are added which prevent reignition of the gases. These salts are generally incorporated in the propellant and are entrained with the gases during its combustion.

The addition of these salts has been observed to have a detrimental effect on the rate of combustion of the propellant.

It has then been proposed, especially in U.S. Pat. No. 3,960,621, to manufacture a propellant by the casting method, using as a moulding powder a mixture of powders, one of which, the first, contains only the antiglare agents as ballistic additives and the other, the second, contains the other ballistic additives and, in particular, the combustion catalysts. The content of antiglare agent in the first powder is high, between 30 and 70% by weight, and the ratio of the first to the second powder in the moulding powder is of the order of 5/95.

The propellants obtained in this manner have satisfactory ballistic properties.

However, this process does not make it possible to obtain propellants with a low temperature coefficient, and the effect of attenuation of the flame glares is not produced when the propellant is used under severe operating conditions, particularly when the nozzle of the propelling device is not adapted or when obstacles are present in its divergent part.

The temperature coefficient of a propellant means the rate of change in the rate of combustion for a temperature rise of 1° C. This value is one of the characteristics of a propellent composition. Thus, a propellant with a low temperature coefficient would be capable of being employed under any temperature conditions, its rate of combustion remaining substantially constant.

Furthermore, a nozzle is said to be adapted when its shape and its size make it possible to obtain a pressure of combustion gases at the outlet of the nozzle which is substantially equal to ambient pressure.

The purpose of the present invention is, in particular, to provide a process for the manufacture of a double-base propellent having a low, or even negative, temperature coefficient, while producing no flame glare and retaining a level of ballistic properties which is similar to that of the equivalent propellants not containing antiglare agents.

For this purpose, the invention provides a process of manufacture, using the method known as casting, of a double-base propellent composition containing ballistic additives and consisting in casting a nitrocellulose-based moulding powder with a casting solvent based on a nitrated oil, in which process the moulding powder consists of a mixture of at least two powders, one of which, the first, contains antiglare agents, characterized in that the said first powder contains at most 15% by weight of antiglare agents, the weight ratio of the said first to the said second powder in the moulding powder being between 15/85 and 50/50.

The first powder preferably comprises at least 5% by weight of antiglare agents.

According to another characteristic of the invention, the first and the said second powder also contain combustion catalysts as ballistic additives.

However, the combustion catalysts may be present solely in the second powder.

In addition, the abovementioned second powder has a low, and preferably negative, temperature coefficient.

Thus, the use of a powder not containing antiglare agents, called the second powder, and of a powder containing a low proportion of antiglare agents, called the first powder, makes it possible to obtain a propellent composition having a temperature coefficient which is substantially close to that of the second powder.

In addition, the level of rate of combustion of the propellent composition according to the invention is substantially equal to that of an equivalent composition containing no antiglare agents.

Furthermore, the antiglare effect is enhanced, since the postcombustion phenomenon is no longer observed during the combustion of the propellant, even under severe operating conditions, and particularly during combustion in a nozzle which is not adapted, or which has obstacles in its divergent part.

Both the first and the second powder may contain other ballistic additives such as anti-instability agents, or energetic agents such as nitramines.

The term ballistic additives means generally all the compounds added to a propellant and affecting either its combustion, in which case these additives are known as combustion catalysts, or the flame or the gas properties, such as anti-instability agents, energetic agents or antiglare agents, these additives being known as agents which do not catalyse the combustion.

The combustion catalysts usually employed in double-base propellants and already known to the expert are suitable for the invention. By way of example of a combustion accelerator, there may be mentioned acetylene black, lead salts and copper salts such as lead oxides, copper oxides, and lead or copper salicylates, octoates, stearates and resorcylates.

It is also possible to use combustion retarders such as, for example, sucrose acetoisobutyrate (SAIB) or sucrose octoacetate (SOA).

As antiglare agents which are suitable for the invention there may be mentioned, for example, potassium sulphate, potassium nitrate, potassium hydrogen tartrate or potassium aluminium fluoride, also known as cryolite. This list is not exhaustive and is given solely for guidance.

Furthermore, as the person skilled in the art is aware, the moulding powder, in other words the first and/or second powders of which it consists, also contains a nitrated oil, nitroglycerine being the oil in the widest use. It may also contain a plasticizer such as, for example, dioctyl phthalate.

According to the invention, the weight concentration of antiglare agent is preferably less than or equal to 10% in the first powder.

Other details and characteristics will be better understood and illustrated in the light of the nonlimiting examples given below solely for guidance.

Several powders A to J are prepared according to a conventional process, consisting in dissolving dehydrated nitrocellulose in an ether-alcohol or acetone-alcohol solvent. Next, during the kneading stage, a plasticizer, ballistic additives and, if desired, a nitrated oil and a stabilizer, are added. The dough thus produced is then drawn, extruded in the form of grains enabling the mould to be well filled, and then freed from liquid and, if desired, soaked, dried and mixed.

The compositions of the various powders prepared are listed in Table I below.

TABLE I

| | A | B | C | D | E | F | G | H | J | K | L |
|---|---|---|---|---|---|---|---|---|---|---|---|
| Nc | 91 | 43,5 | 57,4 | 81 | 75 | 91 | 67 | 67 | 72,5 | 76 | 63 |
| Ng | — | — | — | — | 15 | — | 15 | 15 | 15 | 15 | 15 |
| DOP | 4 | 2 | 2,6 | 3,6 | 5 | 4 | — | — | 3,5 | 5 | |
| SAIB | — | — | — | — | — | — | 3,8 | 3,8 | | | |
| PbO | 1,5 | 0,75 | 1 | 1,35 | 1,5 | 1,5 | 1,1 | 1,1 | | 1 | |
| $Cu_2O$ | 1,5 | 0,75 | 1 | 1,35 | 1,5 | 1,5 | 1,1 | 1,1 | | 1 | |
| 2-NDPA | — | — | — | — | 2 | 3,0 | 2,0 | 2,0 | 2 | 1 | 2 |
| Cent. | 3 | 3,0 | 3,0 | 2,7 — | — | — | — | | | | |
| AB | 0,05 | 0,02 | 0,03 | 0,05 | 0,20 | 0,03 | 0,04 | 0,04 | | 0,05 | |
| Cryo. | — | 50,0 | 35,0 | 10 | — | — | 10 | — | | | |
| $K_2SO_4$ | | | | | | | | 10 | 7 | | |
| HK | | | | | | | | | | | 20 |
| Coef. ($\times 10^{-3}$) | 0,2 | | | | −0,6 | −0,2 | | | | −0,8 | |

Nc: nitrocellulose at 12.6 of $N_2$: nitrocellulose containing 12.6% of nitrogen
Ng: nitroglycerine
DOP: dioctyl phtalate
SAIB: sucrose acetoisobutyrate
2-NDPA: N,N—diphenylamine
AB: acetylene black
Cent.: centralite
Cryo.: potassium cryolite with 1% of DOP
HK: potassium bitartrate
Coef.: temperature coefficient Several moulding powders are prepared by mixing two or more of the above powders A to J, for example in a small mill for 15 minutes.

Each moulding powder thus obtained is then arranged in a mould and then gelled with a casting solvent of the following composition:

| Solvent A | | Solvent B | |
|---|---|---|---|
| Nitroglycerine: | 78% | Nitroglycerine: | 72% |
| Triacetin: | 21% | Triacetin: | 27% |
| 2-NDPA: | 1% | 2-NDPA: | 1% |

The filling ratio is 60%, for each composition prepared. The filling ratio means the relationship of the mass of powder fed into the mould to the mass of the finished propellant.

The composition obtained is then subjected to a conventional heat treatment.

The compositions are tested in bench firing with deadapted nozzles containing a jet interceptor situated in the outlet plane. In the bench used, the jet interceptor shuts off approximately 30% of the outlet area of the divergent part of the nozzle.

The compositions tested have a specific energy of approximately 3553 joules/g and burn at a rate of combustion of approximately 9 mm/s at a pressure of approximately 8 MPa.

The results obtained for each compostion are collated in Table II below. The proportions of each powder A to L in the moulding powder are given in percentage by weight. The compositions in tests 1 to 4 are obtained with the casting solvent A, while those in tests 5 to 12 were obtained using the solvent B.

TABLE II

| | 1 | 2 | 3 | 4 | 5 | 6 | 7 | 8 | 9 | 10 | 11 | 12 |
|---|---|---|---|---|---|---|---|---|---|---|---|---|
| A | 84,63 | 88,25 | 65,86 | 50 | | | | | | | | |

TABLE II-continued

| | 1 | 2 | 3 | 4 | 5 | 6 | 7 | 8 | 9 | 10 | 11 | 12 |
|---|---|---|---|---|---|---|---|---|---|---|---|---|
| E | | | | | 60 | 25 | 60 | 65 | 75 | 85 | 60 | |
| F | | | | | | 35 | | | | | | |
| B | | 11,75 | | | | | | | | | | |
| C | 15,37 | | 34,14 | | | | | | | | | |
| D | | | | 50 | | | | | | | | |
| G | | | | | 40 | 40 | | | | | | |
| H | | | | | | | 40 | 35 | 25 | 15 | | |
| J | | | | | | | | | | | 40 | |
| K | | | | | | | | | | | | 60 |
| L | | | | | | | | | | | | 40 |
| Coef. | 0,8 | 0,5 | 1,3 | 2,6 | 0,3 | 1,3 | 0,5 | −0,2 | −0,6 | −0,7 | −0,4 | −0,4 |
| P | 3456 | 3456 | 3330 | 3427 | 3582 | 3657 | 3624 | 3624 | 3620 | 3595 | 3616 | 3607 |
| PC | yes | yes | yes | no | no | no | no | no | no | no | no | no |

Coef.: temperature coefficient ($\times 10^{-3}$)
P: Specific energy (joule)
PC: post-combustion The tests 1 and 2 are comparative tests and correspond to the process described in U.S. Pat. No. 3,960,621. The results show that the postcombustion phenomenon is not eliminated, even in test 3 in which the moulding powder was obtained with a high proportion of powder (C) containing an antiglare agent.

In all the other tests according to the invention, the postcombustion phenomenon does not occur and compositions with a low, and even negative (tests 8 to 11), temperature coefficient may be obtained.

The invention is not limited to the examples. Thus, the contents of nitrocellulose, nitroglycerine, plasticizer or combustion catalysts in the moulding powder are not critical; the same applies to the filling ratio and the composition of the casting solvent.

What is claimed is:

1. Process for the manufacture, by the casting method, of a double-base propellant composition exhibiting specific energy in Joules higher than 3330, free from post-combustion and containing ballistic additives which consists of casting a nitrocellulose-based molding powder with a casting solvent based on a nitrated oil, wherein the molding powder consists of a mixture of at least two powders, one of which, the first powder, contains anti-glare agents, and the second powder is free of antiglare agents, the first powder contains at most 20% by weight of antiglare agents, the weight ratio of said first powder to said second powder in the molding powder being between 50:50 and 15:85.

2. The process according to claim 1 wherein said molding powder contains 40–50% of said first powder containing said antiglare agent and said first powder contains 10% of antiglare agent.

3. The process for the manufacture by the casting method of a double-base propellant composition exhibiting specific energy in Joules higher than 3330, free from combustion and having negative temperature coefficient, said composition having ballistic additives, which consists of casting a nitrocellulose based molding powder with a casting solvent based on a nitrated oil, wherein the molding powder consists of a mixture of at least two powders, one of which, the first powder, contains an antiglare agent and the second powder is free of antiglare agent, the first powder contains 10% of antiglare agent and said molding powder contains 15–35% of said first powder.

4. The process according to claim 1 wherein said molding powder contains 40% of said first powder, and said first powder contains 7% of the antiglare agent, and the double base propellant exhibits negative temperature coefficent.

5. The process according to claim 1 wherein said molding powder contains 40% of said first powder and said first powder contains 20% of potassium bitartrate as the antiglare agent and said double-base propellant exhibits negative temperature coefficient.

6. The process according to claim 3 wherein said first powder contains 10% of potassium sulfate as the antiglare agent.

7. The process according to claim 1 wherein the first and second powders contain combustion catalysts as ballistic additives.

8. The process according to claim 1 wherein said second powder contains combustion catalysts as ballistic additives.

9. The process according to claim 1 wherein said antiglare agent is a member selected from the group consisting of potassium sulfate, potassium nitrate, potassium aluminum fluoride and potassium hydrogen tartrate.

10. The process according to claim 1 wherein the abovementioned first and second powders contain a nitrated oil.

* * * * *